United States Patent [19]

Jamison

[11] Patent Number: 4,790,534

[45] Date of Patent: Dec. 13, 1988

[54] TABLE TOP GOLF GAME

[76] Inventor: William L. Jamison, 6260 E. 106th St., Noblesville, Ind. 46060

[21] Appl. No.: 829,083

[22] Filed: Feb. 13, 1986

Related U.S. Application Data

[63] Continuation-in-part of Ser. No. 542,723, Oct. 17, 1983, abandoned.

[51] Int. Cl.[4] ..... A63F 7/20; A63B 69/36

[52] U.S. Cl. ..... 273/87.2; 273/DIG. 20; 273/199 R

[58] Field of Search ..... 273/87.2, 87.4, 87 B, 273/87 R, 199 R, DIG. 20

[56] References Cited

U.S. PATENT DOCUMENTS

| | | | |
|---|---|---|---|
| 720,191 | 2/1903 | Taylor | 273/87 C |
| 1,591,095 | 7/1926 | Meyer | 273/87 C |
| 3,537,576 | 11/1970 | Macaluso | 273/87.2 |
| 3,809,404 | 5/1974 | Fikse | 273/87.4 |
| 4,058,313 | 11/1977 | Spradlin | 273/87.4 |

FOREIGN PATENT DOCUMENTS

| | | | |
|---|---|---|---|
| 3063 | of 1911 | United Kingdom | 273/87.2 |

*Primary Examiner*—George J. Marlo
*Attorney, Agent, or Firm*—Robert A. Spray

[57] ABSTRACT

A table-top golf game provides a game board, clubs, and balls, yielding a three-dimensional nature of play simulating that of conventional golf. The board has multi-textured surfaces as playing holes for golf, which include simulated greens, fairways, rough, water hazards and sand traps, and a plurality of tee areas located at varying distances from the greens in order to provide a variety of par three, four and five holes. The clubs have faces of varying angles to achieve shots of varying distances and heights; and, with the exception of the putter, the clubs are spring actuated and may be manipulated to cause various types of shots and trajectories of the game ball. The putter is manually actuated to provide maximum feel to the putting stroke. The ultra light balls have a density of only about 1.3 to 1.7 pounds per cubic foot, and an exterior surface of frictional character such that the combination gives the balls the ability to take advantageous backspin when properly struck, providing air-flight trajectory to all shots and causing the balls to stop or jump backwards, when alighting on the greens. The balls thus achieve and require a realistic playing technique when struck by the game clubs, thereby providing a challenge of directional and distance accuracy of shot making to a miniaturized, air-flight, three dimensional simulation of a full scale game of golf.

1 Claim, 3 Drawing Sheets

TABLE TOP GOLF GAME

RELATION TO OTHER CASE

This is a Continuation-in-Part of U.S. pat. application, Ser. No. 06/542,723, filed Oct. 17, 1983, entitled "Table Top Golf Game" filed by the same inventor, now abandoned.

FIELD AND GENERAL FEATURES OF THIS INVENTION

The present invention relates to a table top golf game, and more particularly, relates to a table top golf game providing quite realistic three-dimensional aspects to the game.

The table-top game board layout provides a generally horizontal base member providing a simulated surface terrain of one or more playing "holes" for golf, and having regions of various textures simulating those of the terrain of a hole or holes of a conventional golf course.

Concepts provide ball-striking implements or "clubs" which are manually operable and which are movable with respect to the base member so that the playing ball may be struck from any location on the base member, as would be the manner of play of conventional golf.

Further, and providing a distinct three-dimensional nature to the game and its play, the concepts provide that the playing ball is of an ultra light nature having very low momentum effect, i.e., a ball-nature whose air-flight trajectory is significantly affected and/or impeded by air friction and air resistance even in a very short flight of about only one foot or less even though in play it is struck hard enough to achieve a significantly air-flight nature of its trajectory.

Further, the ultra light nature of the playing ball also provides that it will have very low momentum, as to bouncing or rolling only a distance of no more than a few inches even on a relatively smooth surface portion of the golf hole terrain, and whose rolling or bouncing capability is significantly retarded to even less distance by soft or frictional texture of other portions of the layout which are purposefully provided to be not so smooth.

The ball has a small size and a sufficiently frictional surface, such that in combination with the ultra light density it will have a back-up characteristic when alighting, if properly struck to impart sufficient backspin, adding to the interest and challenge of the game, and giving more simulation of the play of conventional golf.

The concepts thus provide and achieve for the game a distinct three-dimensional air-flight characteristic, requiring a playing technique similar to conventional golf, i.e., requiring a ball-striking technique achieving mostly air-flight and/or bouncing type of travel of the playing ball, with desirable backspin, except of course as to short shots of a relatively short distance, such as "putts" of conventional golf.

The predominant air-flight characteristic of play of most shots, as in conventional golf, provides that they are generally independent of the surface texture of surface features of the base member of which the shot passes, except as to short shots (putts) in close proximity to the target hole, also simulating this table-top golf game to conventional golf, and adding to its appeal.

The concepts further provide similarity to conventional golf, by providing that the texture of the various portions of the layout, in combination with the ultra-light nature of the playing ball, achieves a significant difference in the amount of bounce or roll which the playing ball will have when striking the game board after its air-flight trajectory; and thereby the game provides, similar to conventional golf, ball-travel variations after alighting onto the game board, generally corresponding to those variations of the various regions, i.e., a golf "fairway", "rough", "traps" or "hazards", "green", etc.

Similarly, although usually to a somewhat lesser extent because of the extremely light nature of the playing ball causing it to rest atop most surface textures, the surface texture variations provide some variations in difficulty of properly striking the ball from its position of rest on various textures.

The concepts further achieve and provide a set of "clubs" by which the player may strike the ball with the desired and fairly critical amount of force and loft to achieve whatever shot-trajectory is desired, and with the satisfaction and challenge of a manual manipulative effort which requires hand/eye co-ordination skill.

PRIOR ART HELPS SHOW UNOBVIOUSNESS

The nature of the inventive concepts, particularly in their achievement of similarity of play, intrigue, and challenge to that of conventional outdoor golf, may be seen by noticing the prior art golf games made on a search of files of the U.S. Patent Office, subsequent to this invention, and by considering a patent cited by the U.S. Patent Office in the application of which the present is a Continuation-in-Part.

The search cited three quite old patents, namely, two patents of H. H. Taylor (U.S. Pat. No. 713,253 of Nov. 11, 1902, and U.S. Pat. No. 720,191 of Feb. 10, 1903), and U.S. Pat. No. 1,591,095 of L. L. Meyer, July 6, 1926.

None of these, however, show or suggest an ultra light ball having low momentum nature, or having the dominant air-flight ball trajectory type of play, even though they show game boards of various terrain features, and in the limited sense a three-dimensional nature, and none show or suggest a specific mallet by which a predominant air-flight trajectory of the playing ball would be achieved. Thus none of these show the interesting similarity of play, of a dominantly air-flight shot nature, similar to that of conventional golf.

In certain respects the prior art asserted by the U.S. Patent Office in the said parent case, application Ser. No. 542,723, is more relevant, although as noticed below it too helps show non-obviousness of this present invention. That prior art reference is the British Patent No. 3,063, of Nov. 9, 1911, to E. A. Short.

The Short 1911 reference uses a ball of "pith" (expressly said in that patent specification to be "essential"), which although lighter than the balls of the three U.S. references, is so heavy as an inherent characteristic that the "tee" or initial shooting area of the Short game must be undesirably spaced away from the game board of the golf course layout.

The Short ball-nature is at least about three times the density of the ball of the present invention, inherently producing quite an undesirable difference as to playing characteristics, such a difference that the ball of the Short reference is not even operatively usable as a ball for this invention's truly table top game.

Indeed, in contrast to suggesting the present invention, the 1911 Short patent would seem to likely discourage the attempt to achieve a truly table top layout of close simulation to conventional golf, for, even though the pitch ball would be fairly light in comparison to many game balls, the Short game ball has already been noted as being so heavy as to require a "tee" area spaced away from the game board, and the Short concepts otherwise fail to provide particulars of the present invention.

For example, the significantly heavier density of the pitch ball of Short, in comparison to the ultra light ball of the present invention, means that the Short pitch ball would be considerably more difficult to get it desirably airborne with just a short distance shot; and thus the extra length of an airborne shot of the heavier-density Short ball, especially when considered also with its inherently higher momentum effect which means for it an inherently longer roll or bounce after alighting, means that the overall length of the shots of Short's heavier-density ball will generally be much longer than with the ultra light and frictional-surface ball of the present invention.

For such reasons as these, the heavier-density Short ball of 1911 does not provide a desirable game of truly tabletop size and nature, especially since the Short patent text expressly specifies a smooth surface to the ball, further indicating a lack of suggestion in the Short reference of a ball having the action of the present invention's ultra light ball and its sufficiently frictional surface to achieve its desired action after alighting, i.e., of desired short amount of after-alighting forward travel, and even a ball "back-up" enviable to most golfers.

In a game of the present invention, a scale is practicable of about "16 inches equals 100 yards", providing ample space on a table top size layout for several "holes" of varying character and varying challenge of play, further distinguishing over the 1911 Short reference and its play characteristics, and further emphasizing the very significant difference between this invention's ultra light ball and the Short patent's three-times-heavier pith ball, as to be realized to be a difference in kind in contrast to mere degree.

And it is noted that although the 1911 Short reference, with its pith ball, was in the prior art long before the 1926 Meyer patent, and was in existence for some 75 years of the existence of various other games mentioned below; and the realistic fact of actual history has been that the 1911 pith ball of Short has not suggested itself to any other person in the world to achieve a distinctly different and more advantageous truly table top golf game with a game ball of only about one third the density of Short's pith ball.

A limited size of game board, as being only about two feet by eight feet, seems to be desired in many homes and to provide a truly table-top use and support; and that limited size correspondingly limits the individual shots to be of a very short distance, especially since the shots are all made from the area of the game board itself in contrast to the 1911 Short game's requirement of a shot-making area on some other surface spaced away from the game board. Thus it is seen that the ultra-light nature of the present invention's balls is of special advantage over balls if even somewhat lighter density than Short's pith balls.

And even further distinguishing the present invention's ultra light ball over Short's pith ball, the pith of Short is realistically probably considerably more than three times as dense as this invention's ultra light ball. This is because reference tables for various woody materials show their densities to be generally over a specific gravity of 0.5, thus over one-half the weight of water and thus a density of over 30 pounds per cubic foot; and thus probably the pith of Short's game was about 15 to 20 times as heavy as the ultra light ball which achieves the remarkably better advantage of the present invention's game over that of the 1911 Short reference, rather than just three times as heavy.

Even balsa wood, a wood of well-known lightness, is of a specific gravity of as high as 0.11 to 0.14; but that is over five or six times the density of the ultra light ball of the present invention; and balsa, as would Short's pith, would be unusable for the truly table top game board layout.

Moreover, pith, which the Short patent text asserts to be essential, seems to be not even available as a commodity, nor is it found cited as such in reference tables giving density or specific gravity values. Thus after the 1911 Short (British) patent was cited in the aforesaid case of this same inventor, the inventor had to cut out the heart section of various growing plants, finding the lightest density one to be about 4.5 pounds per cubic foot; and that has been the only reason it can now be asserted, quite conservatively, that the pith specified as essential by Short could be considered as light as only three-times-heavier than this inventor's concept of use of an ultra light ball.

Thus, the indications from reference tables as to all woody materials actually indicate that Short's pith ball was more than three times as dense as the ultra light ball used in this present invention.

Still further, there is nothing in the relatively heavy Short (British) reference which specifies that the ball would or should be light enough to have significantly different characteristics as to rolling or bouncing (thus as to ball-stoppage) which would manifest themselves within a very few inches depending on the variations in surface texture, as is desirably achieved by the ball of the present invention. Indeed, in contrast, the Short patent seems to use only a single texture, i.e., cloth over a large table, and even bunkers are said to be made of wood (without any indications of having cloth covering which would desirably give more stoppage to simulate that of bunkers in conventional golf); and these factors further negate any concept of the ball being so light as to have different ball stoppage characteristics depending on variations in texture.

The significantly-different ball natures, between the present invention's use of an ultra light ball and the several-times heavier ball of the 1911 Short reference, are further to be noted in that not only is the latter's ball so heavy that its tee shots (the initial shot on any hole being played) must be made from a spaced-away supplemental table, but also it should be noted that the "club" of the Short patent has and requires a significantly large-area base which would seem to preclude its use on the course-layout game board itself, further minimizing even a hindsight inference that the ball of that Short reference patent was to be considered to be light enough so that even shots of less than about a foot could achieve the desired airborne flight characteristics.

In conclusion about the 1911 British reference of Short, an about-three-times heavier nature than the ultra light ball of the present invention would require a game board layout of many feet, much too large to be realistically called or considered a table top game.

Another way of realizing the significant distinction in concept is that this present invention's game components, and particularly the ball, are not merely a scaled-down version of outdoor golf, dimensionally speaking, but the ball itself is of greatly smaller density or specific gravity, an ultralight ball at least three times as feather-weight as the lightest of even any calculated reference, and even much more relatively light than any reference ball apparently available.

These factors, plus the tremendous advantages of this invention's ball's air-borne flight characteristics of shots less than a foot or two on a truly integral table top layout, with an ultra light ball having a frictional surface, provide a game appeal of fun, interest, and skill-needed appeal and challenge quite different from that of the Short or other references, and show that this invention must realistically be considered as non-obvious from the prior art.

The nature of the inventive concepts of the present invention are further seen by the fact that, although for decades there have been an increasing interest and popularity of golf, and creation of many types of table top games, it has been well over 50 years since these prior art games of the search were known and published, and over 75 years since the 1911 British patent to Short, yet no one prior to this invention has found it obvious to create a truly tabletop predominantly three-dimensional golf game of substantially airborne-shot nature differing as it does from all those references, even though an indoor game is shown as known by these various reference patents, and even though many other realistic factors exist by which this present invention could have been achieved if indeed it has really been obvious.

That is, (a) various other scaled-down or indoor versions of golf have been widely known, such as "miniature golf", "par-3" golf courses, pool table golf, etc., and (b) some "miniature golf" layouts have some three-dimensional terrain features and even some falling-ball incidents which give some through-the-air nature of certain shots; (c) certain other scaled-down or arcade versions of games such as basketball use a lightweight (table tennis) type ball with airborne three-dimensional nature of play; (d) there are games such as table tennis and badminton which also have a lightweight ball having air-flight nature of play; (e) certain arcade games such as of hockey or soccer provide for the hitting of a puck or ball from a plurality of locations; (f) spring-loaded implements are used to strike balls as in arcade baseball and pinball games; (g) terrain simulations have been long used for the many reasons from model train layouts to the golf-terrain simulation by the patents found on the preliminary search; (h) all the materials for easy construction of all the components of this game have been widely available for many years, etc. The widely-known existence and use of those several concepts, as illustrated by the many cited above, emphasize not only the cleverness but the non-obviousness and inventive novelty of this realistic golf game of truly a table top nature.

Further, the nature of the present inventive concepts may be further realized and appreciated by expressly contrasting all the prior art and the illustrative games such as mentioned above, considering all of them as available prior art from which only the present invention has achieved the present concepts. The very existence, and the universal knowledge of all this prior art and prior knowledge, did not however produce the present invention. These things, plus the non-technical nature of the present concepts, which are within the capabilities and understanding of most any person in the world except for the lack of creative insight of those other persons, help understand the non-obvious nature and real novelty of these concepts in a truly table top golf game.

SUMMARY OF INTRODUCTORY PORTION, AND BRIEF DESCRIPTION OF THE DRAWINGS

The above is generally of introductory nature, such as to generally describe the concepts and achievements of the invention, to contrast the inventive concepts with prior art games which are shown to fail to provide the many similarity factors to conventional golf as here achieved, and to indicate factors of the realistic similarity of the truly table-top golf game of this invention to conventional golf; and more particular details, features, and concepts will be more apparent from the following, more detailed description of an embodiment illustrative of the invention's concepts, reference being had to the accompanying, generally schematic drawings, in which:

DETAILED DESCRIPTION OF PREFERRED EMBODIMENT OF THE INVENTION

Figure 1:
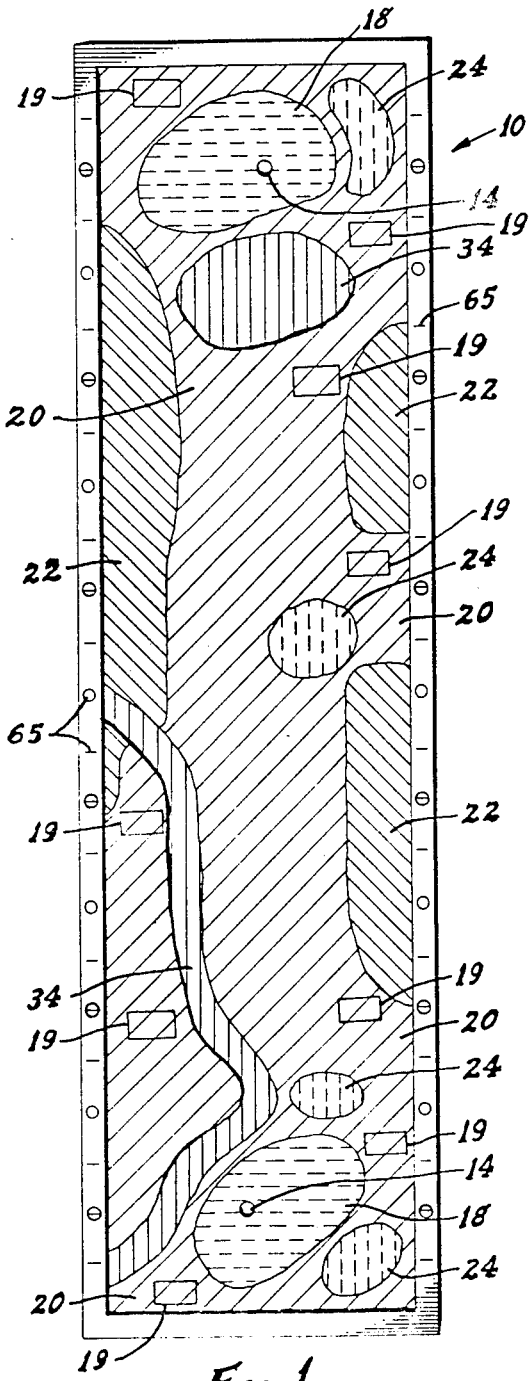
FIG. 1 is a plan view of a table-top game board and layout, illustrating a base member having imposed thereon two golf "holes" providing various portions of varying surface texture, including "tee area", "fairway", "rough", "traps", including "water traps" and "sand traps" as "hazards", "green", "out-of-bounds" boundaries, "hole", and calibration markings.

As shown in the drawings, the present invention provides an interesting and challenging table top golf game, quite definitely corresponding to conventional golf in challenge, intrigue, satisfaction of manual manipulation of a ball-striking implement, variety of conditions, and even the "good or bad luck" which is an incident to much of golf except perhaps when played by experts.

The game layout, as shown, provides a generally horizontal base member 10 for providing a simulated surface terrain of one or more playing "holes" for the golf game, and providing regions of play and terrain through both the starting and stopping of a playing ball 12 as each shot is made as each hole is played.

As with conventional golf, in which the ball is struck whatever number of times it takes to finally get the ball 12 in the hole 14, the concepts provide ball-striking means or clubs 16 which are movable about and with respect to the base member 10, and which provide that the playing ball 12 may be struck from any location on the base member 10 to impart energy to the ball 12 so that its movement has a substantial air-flight characteristic.

The nature of play, like that of conventional golf, has substantial air-flight travel of the playing ball 12 on most shots; and this is achieved by providing the ball to be an ultra-light playing ball 12 whose ultra-light nature is sufficient to cause a low momentum effect in which its air-flight trajectory is significantly affected and/or impeded by air friction and air resistance. This effect is an incident of its air-flight travel even in a flight of about only one foot or less, even though it is struck hard enough to achieve a desired and significantly air-flight nature of its trajectory; and it will retain backspin when properly struck so as to "back up" when alighting on the game board, if struck to impart backspin. And even if no backspin has been imparted by the striking, the ultra-light nature of the ball 12 is also such that it will have very low momentum as to bouncing or rolling only a distance of no more than a few inches even on a smooth surface, and whose rolling or bouncing capability is significantly retarded to even less distance by soft or frictional texture of the base member 10 as is herein indicated.

The ultra-light nature and frictional surface of the balls 12 is desirably provided by forming them of expanded polystyrene bead form, having light density of from about 1.3 to 1.7 pounds per cubic foot, or a specific gravity of only about 0.021 to 0.027; and the balls 12 are about one-half inch or slightly less in diameter. This is with a base member 10 of about two feet by eight feet; and the game provides desired air-flight characteristics similar to conventional golf, and providing a game advantageously different from prior art games as already noted and explained.

The balls 12, as well as features of the base member 10 and clubs 16, as are further described herein, provide that the game has a distinct three-dimensional air-flight characteristic, in which mostly air-flight and/or bouncing type of travel of the playing ball 12 is to be had, except as to short shots of a relatively short distance in relatively close proximity to the area designated as the target area of the game, such as "putts" onto or on the target "green" 18 of each hole to be played.

The air-flight ball-travel characteristic of this game, as with conventional golf, also requires air-flight shots of the playing ball 12 which are generally independent of the surface texture or surface features of the base member 10 except of course as to such short shots as "putts" in close proximity to the target area, of green 18 or hole 14 as the case may be.

It will be noted that the layout board 10 has two of the greens regions 18, each of course with a hole 14 cut therein, the greens 18 being at opposing ends of the board 10; and with nine tee areas 19 marked on various locations, the board 10 layout provides for a game of nine holes.

FIG. 1 illustrates the provision of the generally horizontal base member 10 with a plurality of regions of differing surface texture, to add challenge and a similarity to that of conventional golf.

Thus, noticing both FIG. 1 and all of FIGS. 4 through 8, one of the game board regions 20 is that of intermediately textured surface in which a playing ball 12 alighting thereon will have an intermediate amount of bounce or roll; and the intermediately textured surface will provide a good "lie" for a ball 12, i.e., such region 20 is provided to have a minimal or low amount of portions upstanding which would obstruct the "making of a shot", i.e., would be interferingly disposed between the playing ball 12 resting on the surface 20 and the path of a striking means moving toward the playing ball from a position above that surface and behind the ball. Such an intermediately textured surface 20 thus provides for the game a relatively desirable or "fairway" region surface 20 onto which the player may desire to cause his playing ball to land and from which it is to be struck on his next shot. (The tee areas 19 are desirably marked areas of the fairway 20.)

Variety of shot-making and shot-effect is achieved by providing (FIG. 1 and FIGS. 4–7) another one of the game board's regions to have a relatively high textured surface in comparison to that of the fairway 20, and in which a playing ball alighting thereon will have relatively small amount of bounce or roll; and the relatively highly textured surface will provide a less desirable "ball lie" than does the fairway 20, i.e., it will have relatively more portions upstanding which would to some extent obstruct the "making of the shot", i.e., would be interferingly disposed between the playing ball 12 resting thereon and the path of a striking means moving toward the playing ball 12 from a position above the surface and behind the ball. Such a relatively highly textured surface-texture, in comparison to that of the fairway 20, thus provides a relatively undesirable region or surface onto which the player would not desire his playing ball 12 to land and to have to be struck therefrom on the player's next shot from a "lie" upon such surface, or to some extent nestled into that surface.

Desirably there are provided at least two types of relatively highly textured surfaces, of the types of surfaces less favored than that of the fairway 20. One of those relatively highly textured surfaces is of relatively more desirable nature as to characteristics set forth with respect to desirability, providing a "rough" 22, being a somewhat undesirable region for the game, as illustrated in FIGS. 1 and 7; and another of which is of relatively less desirable nature as to such desirability characteristics, thus providing a "sand-trap" 24 or significantly undesirable region, as a trap or hazard for the game, as illustrated in FIGS. 1, 4, and 5.

In contrast to the relative roughness of the regions of fairway 20, rough 22, and sand-trap 24, the game board 10 is provided to have one or more target areas which are each provided to have a generally smooth surface, and whose surface texture provides a longer roll of the playing ball 12 than that of the other regions 20, 22, and 24 (i.e., the terminal portion of ball-movement, having reference to an initial playing ball movement of the same speed on each of those other surfaces 20, 22, and 24), and thus each smooth target area provides a "green" 18 for the game board layout 10.

Figure 5:
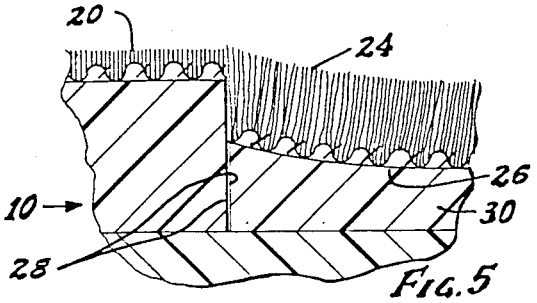
FIG. 5 is an enlarged detail view of a portion of FIG. 4, better to illustrate desired junction of the sand trap hazard and adjoining fairway region, for an embodiment in which there is desired no "lip" at the ends of the hazard.
Figure 4:
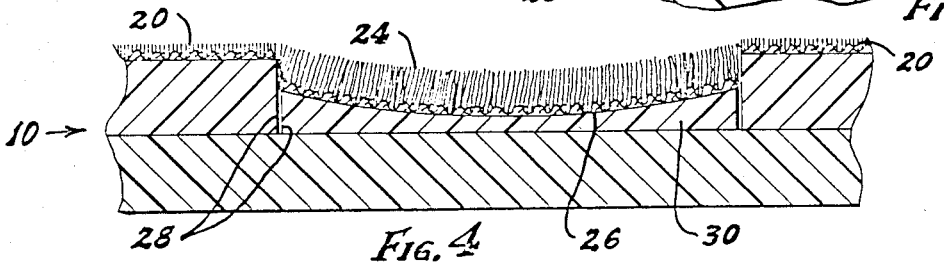
FIG. 4 is a cross-sectional view of the base members having spaced portions of "fairway" between which portions is a region of a "sand trap" hazard.
Figure 6:
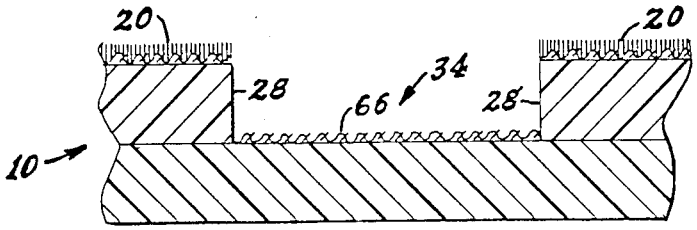
FIG. 6 is a cross-sectional view similar to FIG. 4, but illustrating a "water hazard" interposed between adjacent fairway portions.
Figure 7:
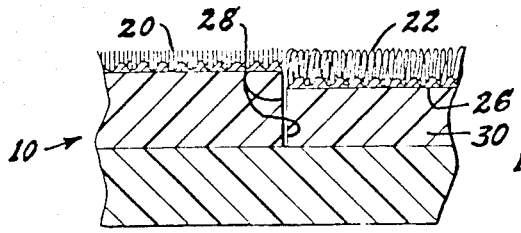
FIG. 7 is a cross-sectional view similar to FIG. 4, but illustrating adjacent portions of fairway and rough.

FIGS. 4, 5, and 7 illustrate the provision of the rough 22 and sand trap 24 regions, in which the base member 10 is cut as at 26 over its upper surface in the region of its relatively highly textured surfaces 22 and 24, the cut 26 being of a depth such that the top surface of the relatively highly textured surfaces 22 and 24 extend substantially as high as the top of the adjacent edge portion of the intermediately textured fairway surface 20. This provides a no-lip nature of the rough 22 or trap 24 if desired; and it avoids excessive distance of ricochet of a shot striking a lip, which ricochet would likely be of an unreasonably long distance, considering the game board dimensions, in comparison to the proportionate length of a ricochet on a conventional golf course.

The FIGS. 4, 5, and 7 also illustrate a desired formation of the layout board 10 as two juxtaposed slabs, each board area 22 and 24 being made by a vertical cut 28 clear through the upper slab, peripherally around the area 22 or 24; then, after the cut-out area or block 30 is suitably provided with surface 22 or 24 as herein more fully illustrated, the block 30 is re-placed in the region of the cut 28.

Figure 8:
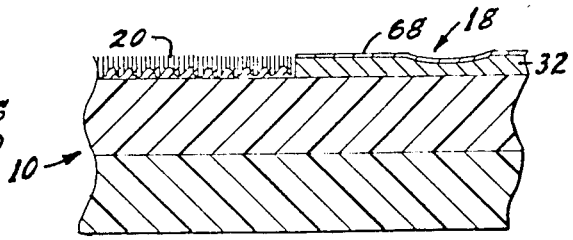
FIG. 8 is a cross-sectional view similar to FIG. 4, but illustrating adjacent portions of fairway and green.

Also providing no unnatural lip along the periphery of the green 18, the adjacent portions of the upper surface of the target green 18 and of the intermediately textured fairway surface 20 are substantially flush, as shown in FIG. 8, thereby avoiding the blocking or other unnatural effect of a playing ball 12 in rolling onto the target green 18 from the adjacent portion of the fairway 20; and the green 18 is shown in FIG. 8 as provided by a block 32 substantially as high as the textured surface 20 of the fairway.

Water hazards 34 (FIGS. 1 and 6) are shown as provided similarly to the areas of rough 22 and sand traps 24, i.e., by a peripheral cut 28. Desirably, the cut 28 peripherally of the water trap area 34 is vertical, and is left vertical to minimize the chance of a ball 12 alighting therein to roll out.

Figure 2:
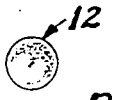
FIG. 2 is a view of a playing ball, in larger scale.
Figure 3:
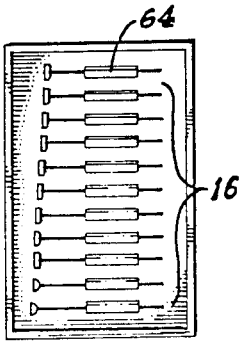
FIG. 3 is a view of a box of a set of ball-striking implementations or "clubs", in about the same scale as in FIG. 1.
Figure 9:
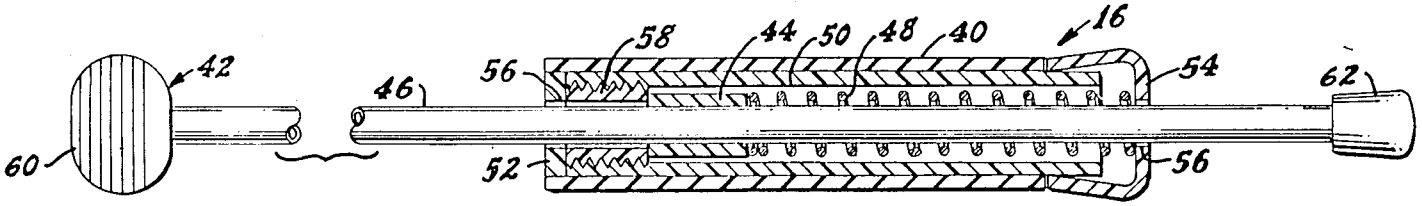
FIG. 9 is an enlarged longitudinal cross-sectional view of a ball-striking implement or "club" used in playing the game.

FIGS. 3 and 9 illustrate the ball-striking implements or clubs 16, shown as a set in FIG. 2. Each club 16 (except the putter as described below) is shown as having a manually graspable support tube or member 40 and a ball-engageable club-head member 42; and there are provisions for imparting both force and direction to the club-head 42 as the player holds the device by its outer support member 40, by them being relatively movable, and by the support member 40 having direction-guiding means which provide some control of the direction of the ball-engageable member 42 with respect to the orientation of support member 40.

Such guide means is shown in the embodiment of FIG. 9 as a tubular enlargement 44 on a central or intermediate portion of the shaft 46 which carries the club-head 42 which provides a bottom for a spring 48 ensleeved over the rear portion of the shaft 46, as well as provides an outer surface guided by its sliding movement within an inner bore 50 of the support tube 40. Guidance of the shaft 46 and thus also of the club-head 42 is also provided by walls 52 and 54 at the forward and rearward ends respectively of the support tube 40, and more particularly by central holes 56 in the walls 52 and 54 having a sliding fit with the club-shaft 46 which passes through those holes.

Rearwardly adjacent the front wall 52, the tube 40 is provided with a fixed bushing 58 whose inner diameter also may provide sliding guidance of the club-shaft 46, and which provides an abutment against which the shaft-enlargement 44 abuts at the forward limit of travel of the club-shaft 46 under bias of compression of the spring 48, the rear end of which bottoms against the rear wall 54.

Figure 10:
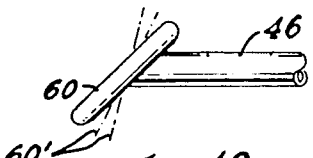
FIG. 10 is a fragmental detail of a portion of FIG. 9 as viewed from the side thereof.

The ball-engageable members 42 of the clubs 16 each have ball-engageable faces 60 which are at differing angles with respect to the respective ball-engageable member 42, and with respect to the path the shaft 46 is guided, thus imparting differing loft-angles of air-flight trajectory of the playing ball 12 when struck even though the support member 40 of the clubs 16 be held at the same orientation and same proximity to the playing ball. (The differing lofts are schematically indicated by the chain-line showings 60′ of the club-face in FIG. 10.)

Further with respect to the manually-graspable support tube or sleeve 40 and the ball-engageable member 42, the above-described means for guiding the member 42 provide means which are movingly engageable with the ball-engageable member 42 to provide some control of its direction with respect to orientation of the support sleeve 40; and further, it is to be noted that the ball-engaging face 60 (or 60′) of the member 42 is carried at an angle with respect to the path of which the ball-engageable member 42 is movably guided by the support means of the support member 40, such that the ball-engageable face 60 will impart an upwardly-directed path for an air-flight trajectory of the playing ball 12 even though the support member 40 is being held in an orientation such that the path of the ball-engageable member 42 as guided by the support member 40 has a downward or horizontal inclination.

It will be further noted that the mounting of the coil spring 48 (between wall 54 and shaft-enlargement 44) is such as to permit the player to manually stress the spring 48 to bias it toward ball-striking operatively by releasing the stress in the spring; and since the club-head force is dependent upon the amount of spring recoil, the player must use judgment as he loads the spring 48 by pulling rearwardly on a convenience knob 62 at the rear end of the shaft 46.

In contrast to the other clubs 16, a putter club 64 has no spring means 48 or any other movement-control means for its ball-engageable member 42 except solely direction control of the ball-engageable member 42 with respect to the orientation of the support member; i.e., it has guidance of the ball-engageable member 42 by the support tube 40 with which the shaft 46 is relatively slidable, and thus it is used in the manner of a pool cue, by a manual force, of pushing nature, applied to the member 42 by pushing on the end knob 62 and shaft 46 as a pool cue is pushed, guidance as to direction being by the outer support sleeve or tube 40.

The layout board 10 is shown as provided with a distance calibration means 65 extending from each of the greens 18 and more particularly as shown from the hole 14 of each green.

In a desired embodiment, the game board 10 has a fairway 20 which has a relatively smooth but frictional surface generally corresponding to that of a piece of carpeting which is known as indoor-outdoor type; and it gives a desired type of bounce or roll to a shot of the ball. The board areas 22 of rough are made out of a short shag rug texture, which will give very little roll or bounce to the ball alighting thereon, and present more difficulty of achieving a good shot than is achievable on the fairway 20.

The recessed area 34 which provides a water hazard, desirably with a blue upper facing 66, would not usually have actual water in the hazard, but nevertheless the recessed nature of the area 34 gives sufficient definition of the water hazard that the player would have to withdraw his ball therefrom, and with a suitable assessment of penalty.

An area of soft fluffy fur-like material provides the areas for the sandtraps 24 which give a particular difficulty in achieving a shot therefrom due to the ball 12 nestling down somewhat into the strands of such material.

The golf greens 18 are desirably formed to have a smooth paper upper face 68 having some texture, such as a flocked paper.

The golf holes 14 are desirably formed as a cup recessed into the game board 10; and desirably the inside diameter of the cup is only slightly more than one-half inch, i.e., only slightly larger than the diameter of the playing ball 12.

The set of clubs 16 is desirably a "full" set of clubs, i.e., a set of three or four whose clubheads are wood (or imitation wood) and a set of "irons" up through that of a "Number 9"; and the differing taper (60') on all of the clubs corresponds generally to the taper on various conventional golf clubs. All are spring loaded, as stated above, and are actuatable similar to the actuation of a pinball machine shooter component, except the putter, which has no spring and which is used similarly to that of a pool cue. The outer surface of the support tubes 40 desirably is made to look like that of a club "grip" of conventional golf clubs.

The lightness of the board 10, conveniently made of styrofoam slabs, the taper of the club heads, the ability to attain various distances and ball-trajectories, the relative ease and/or difficulty of shooting from the various types of surfaces, the variation in holes by utilizing various ones of the designated tee areas, the hazards, etc., give a three-dimensional and remarkably life-like character to the game.

The layout board 10 may of course be duplicated by one or more similar boards to provide whatever number of golf holes are desired; although it seems that a board having two greens 18 as shown, and carrying a plurality of tee-areas 19, provides ample size and variety.

With the ultra light balls 12, they fly in a three-dimensional trajectory which seems unbelievably realistic, both as to flight-path, and even sometimes hooking and slicing if not skillfully struck. Styrofoam (expanded synthetic resinous material) is particularly desirable for the balls 12, giving not only the ultra light density but providing a sufficiently frictional surface, giving the desired characteristics of airflight and action upon alighting, as mentioned above.

With the low-loft and relative heaviness of a low-lofted iron or wood club 16, the ball can be driven three or four feet or so. The ball 12 can be made to even back-spin, as per skillful golf shots, and bounce and/or roll is similar to that of conventional golf.

Accuracy of shot distance, which is another similarity to proper play of conventional golf, is made here to be desirable for proper play, and is quite important to the game; for, as in the case with conventional golf, the proper distance of flight (and bounce and roll) of the playing ball is necessary to achieve the desired goal of each shot, i.e., closeness to the hole, or getting the ball to stop at a desired place for the next shot.

Thus, a specific challenge of the game is for the player to choose a particular club among the others of the set, and to choose a certain amount of pull on the movable club-member to achieve a desired amount of spring-action for regulating the speed of the club as it strikes the ball, and to choose a certain orientation of the club to get whatever variation the player desires as to the loft-effect of the club-face; and the player has to make these various selections giving consideration to the fixed factors of the game components such as size and density of the ball, spring stiffness, and texture characteristic of the region of the game board on which the player expects the particular shot to land.

A desired size of the game board for home use is about eight feet in length; and when calibrated to provide a length of 600 scale yards (in order to accommodate 500 or more scale yard holes for the "par-5" holes), a scale of 16"=100 yards is desirably used.

Infinite variations are attainable without need of extra components. That is, although some games such as pool or billiards pose infinite variations, this game presents the variability of not only different locations of shots, thus different from mechanical arcade baseball and arcade basketball, but by other variety-factors such as differing tee-placements, the variety of types of shots as caused by the different textures (of fairway, rough, and traps), and even the permitted amount of non-levelness of the gameboard itself in any direction which would make substantially inoperable tabletop hockey or other games.

The main appeal of this novel game is perhaps its aspect of realism. Except perhaps for a table-top bowling game, this game seems infinitely more realistic to the full game than most any other household or arcade mechanical game. But this is not to assert that the intrigue of the game is not due also largely to a sort of golf-like challenge, i.e., the need of judgment, some manual dexterity, etc., as in conventional golf.

SUMMARY

It is thus seen that a table-top golf game according to the inventive concepts, provides a desired and advantageous and novel game, with desirable features of concept, construction, and challenge and interest of playing, achieving a remarkable similarity to conventional golf in many respects.

Accordingly, it will thus be seen from the foregoing description of the invention according to this illustrative embodiment, considered with the accompanying drawings, that the present invention provides new and useful concepts of a novel and advantageous table-top golf game, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. A table top golf game, including in combination:

a generally horizontal base member providing a simulated surface terrain of a playing hole for golf, and providing regions for both the starting and stopping of a playing ball, striking means devoid of any support which could be engaged with the base member to provide guidance to the path of striking encounter against the ball, and also devoid of any support which would prevent the striking encounter against the ball from being at any location on the base member, so that the striking means requires manual support by the golfer both prior to and at the occasion of the striking impact with the ball, the manual support of the striking means being required with respect to both direction and inclination guidance being given to the ball by the striking means, and the striking means being fully movable with respect to the base member and enabling the playing ball to be struck from any location on the base member with sufficient vigor to impart sufficient energy thereto so that its movement has a substantial air-flight characteristic as guided both as to direction and inclination by the said manual support of the striking means, and an ultra-light playing ball formed from expanded synthetic resinous material having a sufficiently low density, including a density range of 1.3 to 1.7 pounds per cubic foot, to cause it to have operative game-play characteristics such that a ball of said material will have a low momentum effect in which its air-flight trajectory is significantly affected and/or impeded by air friction and air resistance even in a flight of only one foot or less even though it is struck smartly enough to achieve an air-flight nature of its trajectory, and which will have a very low momentum as to bouncing or rolling a distance of no more than a few inches on the base member after an air-flight trajectory shot, yet having sufficiently density as to permit the same ball to be also used for putting shots in which no air-flight trajectory is to be imparted to the ball, the ball having an exterior surface of sufficient frictional character, in combination with the very low density of the ball and its overall mass as limited by its small size and very low density, that if sufficient back-spin has been imparted to the ball by the striking means, the ball maintains this back-spin rotation when alighting on the base member so that the ball will jump or bounce backwardly when alighting, thus simulating the action of a conventional golf ball which has been struck by a shot by which significant back-spin has been imparted, the ball thus having a distinct three-dimensional air-flight characteristic inclusive of mostly air-flight and/or bouncing type of travel, and providing the backspin action after alighting as specified above, the ball thus providing a three-dimentional, air-flight type of play to the game, including the requirement of manual support of the striking means prior to and at the occasion of the striking means impacting the ball, thus achieving a simulation of golf in a table top game.

* * * * *

UNITED STATES PATENT AND TRADEMARK OFFICE

CERTIFICATE OF CORRECTION

PATENT NO. : 4,790,534

DATED : December 13, 1988

INVENTOR(S) : William L. Jamison

It is certified that error appears in the above-identified patent and that said Letters Patent is hereby corrected as shown below:

Col. 3, line 5 Change "pitch" to "pith".

Col. 3, line 12 Change "pitch" to "pith".

Col. 3, line 13 Change "pitch" to "pith".

Col. 7, line 36 Change "form" to "foam".

Col. 10, line 32 Change "operatively" to "operativity".

Signed and Sealed this

Seventeenth Day of October, 1989

*Attest:*

DONALD J. QUIGG

*Attesting Officer*

*Commissioner of Patents and Trademarks*